US007230590B2

(12) United States Patent
Kim et al.

(10) Patent No.: US 7,230,590 B2
(45) Date of Patent: Jun. 12, 2007

(54) METHOD AND APPARATUS FOR DRIVING DISPLAY PANEL USING PULSE WIDTH MODULATION

(75) Inventors: Hak Su Kim, Seoul (KR); Jung Bae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 249 days.

(21) Appl. No.: 10/126,547

(22) Filed: Apr. 22, 2002

(65) Prior Publication Data

US 2002/0158892 A1 Oct. 31, 2002

(30) Foreign Application Priority Data

Apr. 25, 2001 (KR) ..... 2001-22283

(51) Int. Cl.
*G09G 3/30* (2006.01)

(52) U.S. Cl. ..... 345/76; 345/690; 315/169.3

(58) Field of Classification Search ..... 345/76–81, 345/690; 315/169.1, 169.3
See application file for complete search history.

(56) References Cited

U.S. PATENT DOCUMENTS 5,789,870 A * 8/1998 Remson ..... 315/194
5,999,150 A * 12/1999 Nighan et al. ..... 345/79
6,023,259 A 2/2000 Howard et al. ..... 345/76
6,038,153 A * 3/2000 Andersson et al. ..... 363/97
6,169,372 B1 * 1/2001 Kobayashi et al. ..... 315/169.3
6,191,535 B1 * 2/2001 Saitou ..... 315/169.3
6,198,226 B1 * 3/2001 Koskuba, Jr. ..... 315/169.3
6,310,589 B1 * 10/2001 Nishigaki et al. ..... 345/76
6,507,156 B2 * 1/2003 Aitchison et al. ..... 315/169.1
2003/0117420 A1 6/2003 Ando et al. ..... 345/690

FOREIGN PATENT DOCUMENTS

EP 0372364 A1 6/1990
EP 0 379 807 A1 8/1990
EP 1033902 A2 9/2000
JP 03 157690 A 7/1991
JP 11 045071 A 2/1999
JP 2000-310968 11/2000

* cited by examiner

*Primary Examiner*—Amr A. Awad
*Assistant Examiner*—Michael Pervan
(74) *Attorney, Agent, or Firm*—Ked & Associates, LLP

(57) ABSTRACT

A method for driving a display panel is disclosed to form a desired waveform in driving a pulse width modulation (PWM) mode for adjusting a gray scale level. The method for driving a display panel includes the steps of turning off a plurality of signals respectively applied from a data line and/or a scan line based on a falling edge of one scan pulse, and transiting the signals to a turn-on state to have a predetermined pulse width, thereby adjusting a gray level of the signals using a pulse width modulation mode.

7 Claims, 4 Drawing Sheets

METHOD AND APPARATUS FOR DRIVING DISPLAY PANEL USING PULSE WIDTH MODULATION

This application claims the benefit of the Korean Application No. P2001-22283 filed on Apr. 25, 2001, which is hereby incorporated by reference.

BACKGROUND OF THE INVENTION

1. Field of the Invention

The present invention relates to a display device, and more particularly, to a method for driving a display panel to form a desired waveform in driving a pulse width modulation (PWM) mode for adjusting a gray scale level.

2. Discussion of the Related Art

Generally, a gray scale level in a display device means an achromatic color system corresponding to colors from white to black.

To digitally drive such a gray scale, a PWM driving method is widely used. The PWM driving method is used for almost display devices regardless of passive driving or active driving.

FIG. 1 shows a circuit for adjusting a gray scale level of an organic electroluminescent (EL) panel according to the related art. As shown in FIG. 1, a PWM controller is added to a segment driving part of the organic EL panel.

The PWM controller added to the segment driving part is controlled in accordance with a segment signal, so that a pulse width of a signal applied to the display device is adjusted, thereby setting a gray scale level.

However, in such a PWM driving method, since a start time on all data lines of a data segment is fixed, a problem may occur in case of an organic EL panel.

Such a problem will be described with reference to the accompanying drawings.

FIG. 2 shows a PWM driving waveform of a related art display panel.

Referring to FIG. 2, the PWM driving method according to the related art is performed in such a manner that all signals are simultaneously turned on for one scan pulse width Ts and when a desired pulse width is obtained, a data line signal is shorted to turn off pixels.

Such a PWM driving method results in distortion of the waveform due to fluctuation of a voltage in an anode line in case of an organic EL panel.

In other words, on data line of a data segment of FIG. 1, a signal type of a first data line corresponds to a data line signal turned on within one scan pulse width, a signal type of a second data line corresponds to a data line signal turned on for a time period T2 only, and a signal type of a third data line corresponds to a data line signal turned on for a time period T1 only.

A signal waveform of an anode line applied to the panel through a driver shown in FIG. 1 is the same as signal waveforms of first, second and third anode lines.

In other words, since there is no signal waveform shorter than a signal waveform of the third anode line, the signal waveform of the third anode line occurs normally. However, a wave distortion A occurs in a signal waveform of the second anode line due to the signal waveform of the third anode line. Two wave distortions B and C occur in a signal waveform of the first anode line due to the signal waveforms of the second and third anode lines.

The wave distortions give an adverse effect to longevity of the display device due to luminance and momentary high voltage.

To solve such a problem, a PWM driving waveform as shown in FIG. 3 has been supposed.

Referring to FIG. 3, if no signal is input from the data line of the data segment to the display device, the display device floats the anode line to naturally consume charges inside the organic EL panel.

Momentary change in the signal waveform of the anode line is relieved as the charges inside the organic EL panel are naturally consumed. As shown in FIG. 3, it is noted that distortion of the signal waveform on the anode line is reduced.

However, the PWM driving method of FIG. 3 has a problem in that it is difficult to exactly adjust a gray level due to waveform of the PWM. Also, charges trapped inside pixels give an adverse effect to longevity of the display panel.

SUMMARY OF THE INVENTION

Accordingly, the present invention is directed to a method for driving a display panel that substantially obviates one or more problems due to limitations and disadvantages of the related art.

An object of the present invention is to provide a method for driving a display panel that is not affected by an anode line and exactly adjusts a gray scale.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for driving a display panel includes the steps of previously turning off a plurality of signals respectively applied from a data line and/or a scan line based on a falling edge of one scan pulse, and next transiting the signals to a turn-on state to have a predetermined pulse width, thereby adjusting a gray level of the signals using a pulse width modulation mode.

Preferably, the signals are turned off from a time period of a falling edge of one scan pulse within one scan pulse width and then turned on from a time period of a difference between one scan pulse width and a predetermined pulse width of each signal.

In another aspect of the present invention, a method for driving an organic EL panel includes the steps of turning off a plurality of signals respectively applied from a data line and/or a scan line based on a falling edge of one scan pulse, and transiting the signals to a turn-on state to have a predetermined pulse width, thereby adjusting a gray level of the signals using a pulse width modulation mode.

Preferably, the signals are turned off from a time period of a falling edge of one scan pulse within one scan pulse width and then turned on from a time period of a difference between one scan pulse width and a predetermined pulse width of each signal.

In other aspect of the present invention, a method for driving a display panel includes the steps of fixing a turn-off time period of a plurality of signals applied from a data line and/or a scan line based on a falling edge of one scan pulse and transiting the signals to a turn-on state to have a predetermined pulse width based on the fixed turn-off time period, thereby adjusting a gray level of the signals using a pulse width modulation mode.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A method for driving a display panel according to the present invention will be described with reference to the accompanying drawings.

Figure 4:
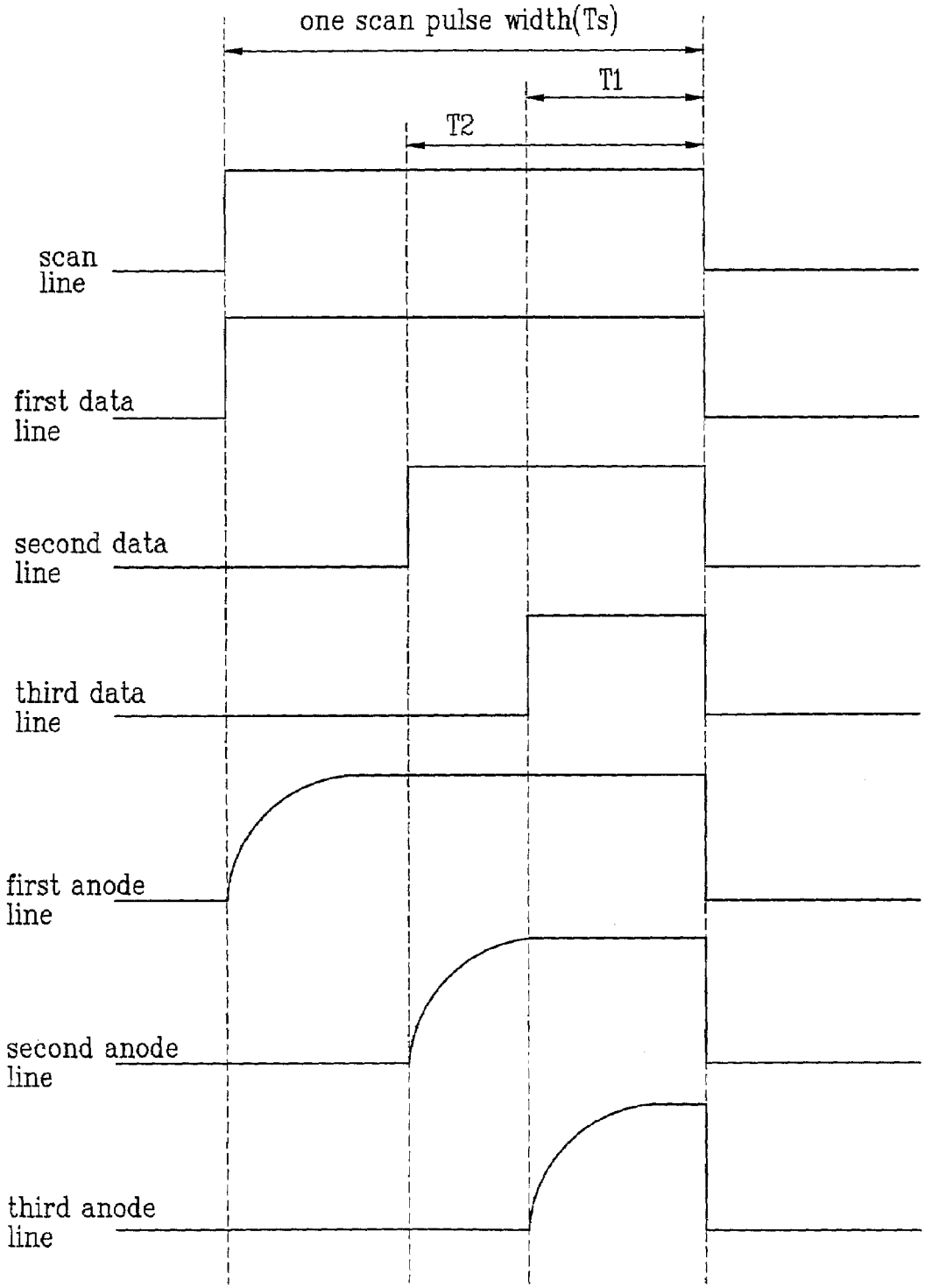
FIG. 4 illustrates a PWM driving waveform of a display panel according to the present invention.

FIG. 4 illustrates a PWM driving waveform of a display panel according to the present invention.

Referring to FIG. 4, a plurality of data signals applied from a data line of a data segment are turned on for a pulse width adjusted by PWM based on a falling edge of one scan pulse, so that a gray level is adjusted. At this time, a turn-off time period of signal waveforms applied from all the data lines based on the falling edge of one scan pulse is fixed. Afterwards, the signal waveforms are turned on to maintain the adjusted pulse width.

If data having a long pulse width that turns on the data line is applied, the pulse width of the turned-off data line becomes short and the pulse width of the turned-on data line becomes longer. However, the whole scan pulse width is maintained unchanged.

As an example, on the data line of the data segment, a signal waveform of a first data line corresponds to a data line signal turned on within one scan pulse width, a signal waveform of a second data line corresponds to a data line signal turned on for a time period T2 only, and a signal waveform of a third data line corresponds to a data line signal turned on for a time period T1 only.

Figure 1:
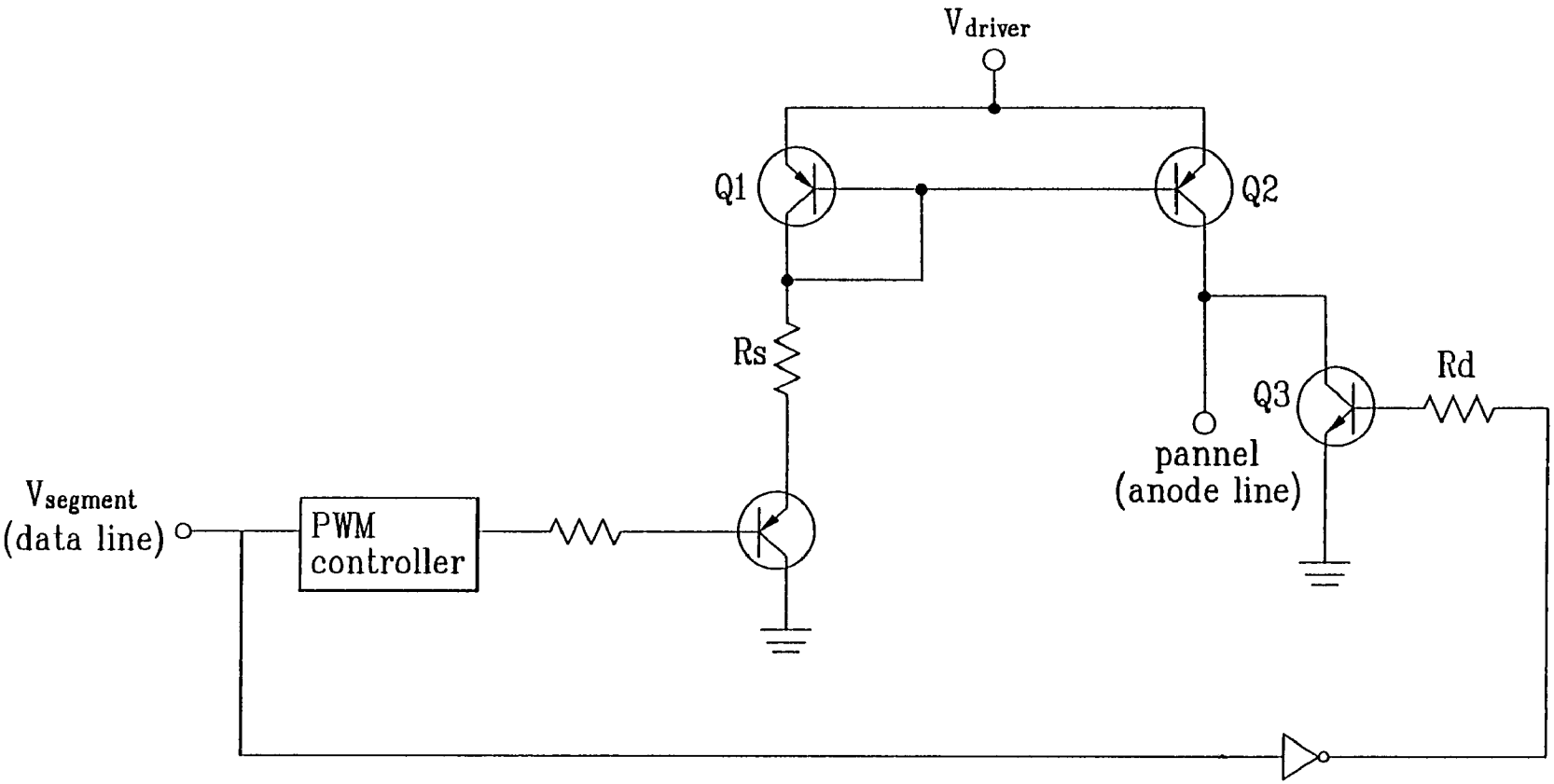
FIG. 1 PRIOR ART
FIG. 1 illustrates a circuit for adjusting a gray scale level of an organic EL panel according to the related art.
Figure 2:
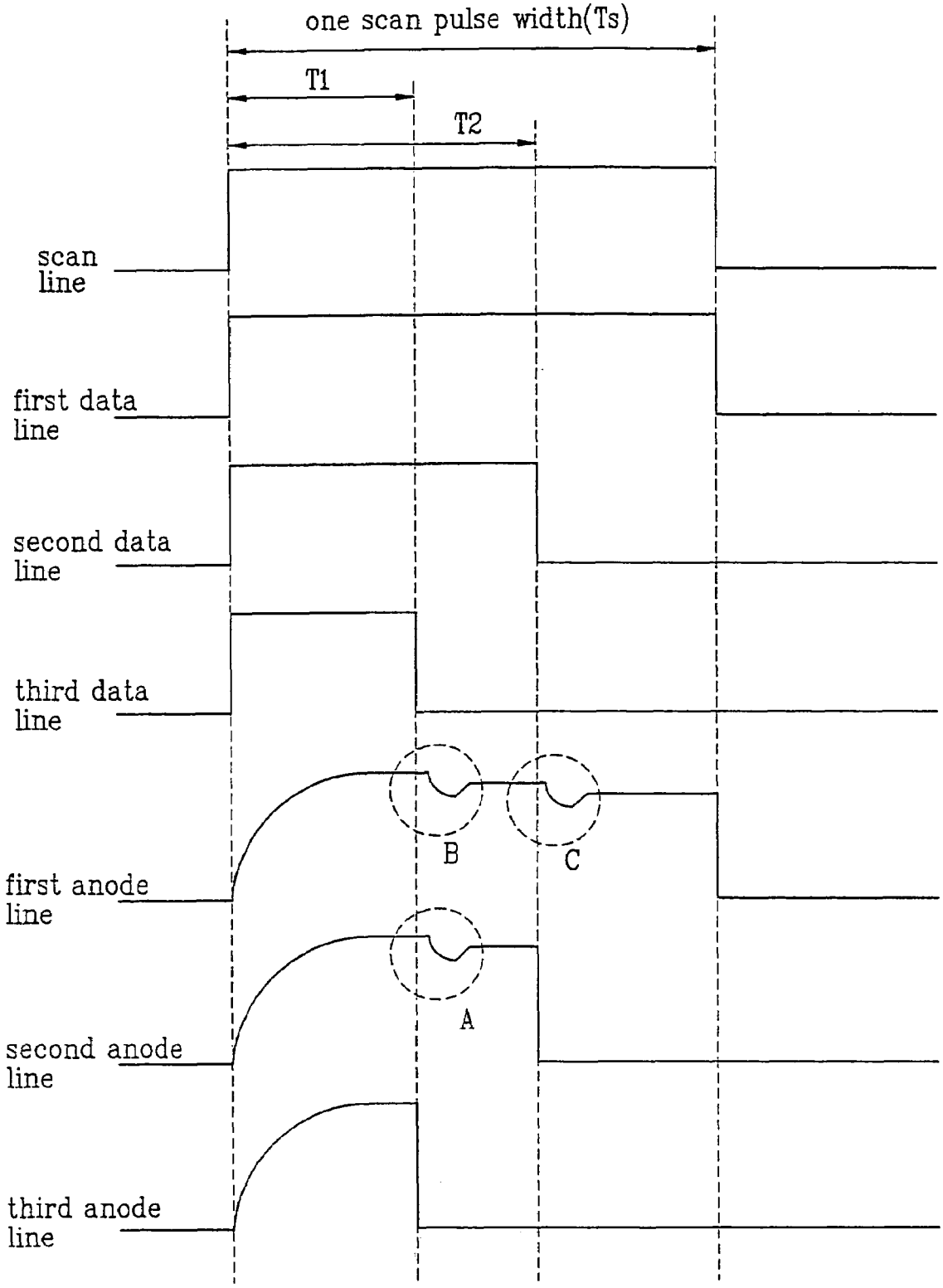
FIG. 2 PRIOR ART
FIG. 2 illustrates a PWM driving waveform of a related art display panel.
Figure 3:
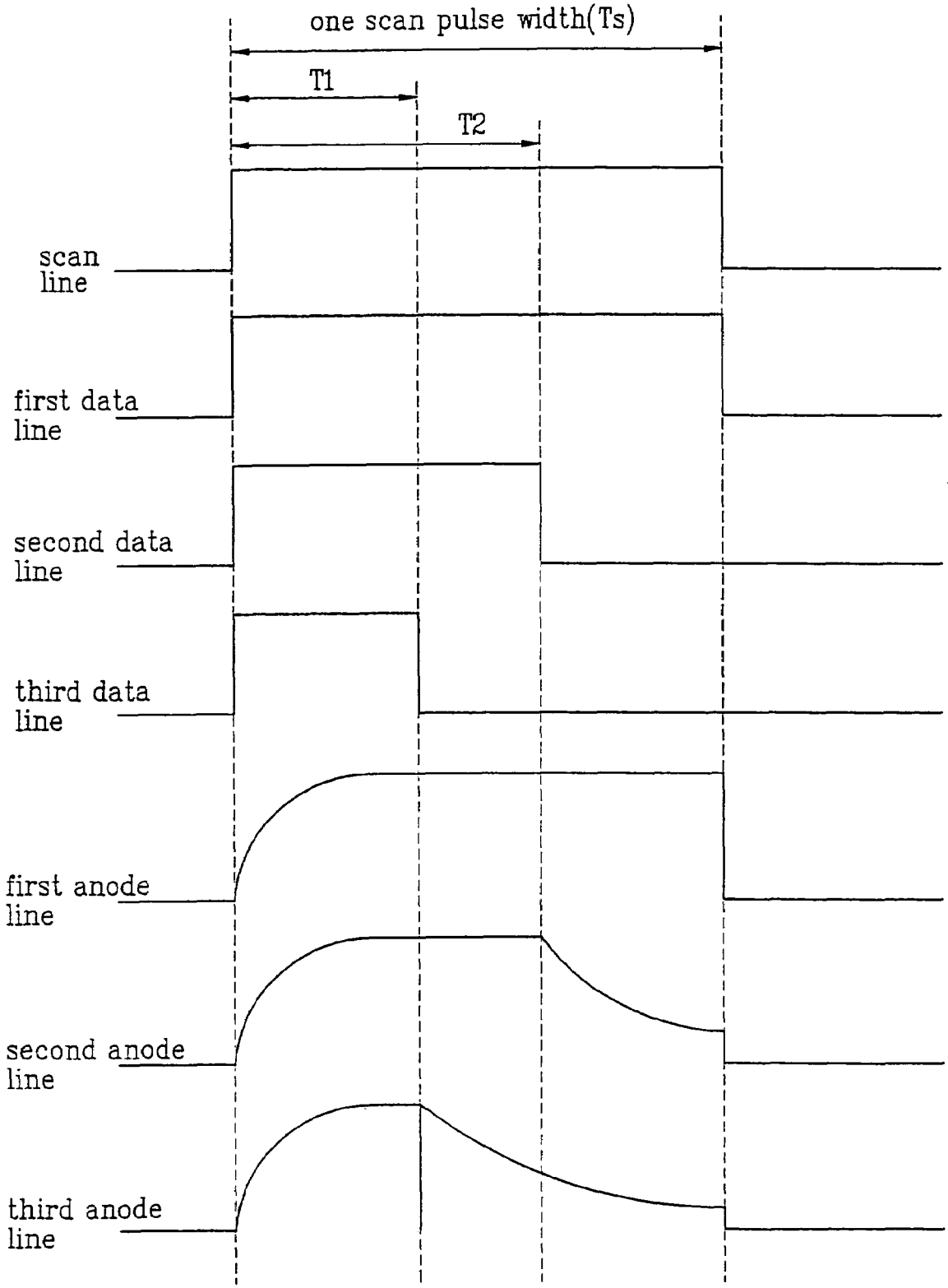
FIG. 3 PRIOR ART
FIG. 3 illustrates an improved PWM driving waveform of a related art display panel.

The signal waveform of the anode line applied to the panel through the driver shown in FIG. 1 is the same as the waveforms of the first, second and third anode lines.

In other words, signal waveforms of the first anode line and the first data line are turned on for a time period of Ts, while the signal waveforms of the second anode line and the second data line are turned off for a time period of Ts−T2 and turned on for a time period of T2. The signal waveforms of the third anode line and the third data line are turned off for a time period of Ts−T1 and turned on for a time period of T1.

The signal waveforms of the first to third anode lines have a slope period for a predetermined time from the time when they are turned on.

As described above, in the present invention, at least one data line and at least one anode line based on a falling edge of one scan pulse are initially turned off. To maintain turn-on time by the predetermined pulse width, the data line and the anode line are transited to turn-on state at a corresponding time period. Therefore, momentary change in waveforms can be relieved and a gray level can exactly be adjusted.

Since one scan pulse width is in advance defined, the pulse width applied to the data line and the anode line can simply be adjusted based on a falling edge of one scan pulse.

As aforementioned, the method for driving a display panel according to the present invention has the following advantages.

First, it is possible to provide a method for generating an exact gray scale. Second, it is possible to provide a clear driving signal waveform having no distortion. Third, no overvoltage is applied to pixels even in case of signals having different pulse widths. Consequently, it is possible to provide a good effect to longevity of the organic EL panel.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method for driving an organic EL panel comprising:

applying a scan pulse of period Ts to a scan electrode; and applying data pulses having pulse widths according to a gray scale of input data to all data electrodes corresponding to the scan pulse, wherein all of the pulse widths of the data pulses are modulated to be turned-off based on the point of a falling edge of the scan pulse after being turned on based on the gray scale of input data, wherein each pulse width of the data pulses has an on-period Tx following an off-period Ts−Tx during the scan pulse period Ts.

2. The method of claim 1, wherein the data pulse includes "Off" period which is turned off until a rising edge of the scan pulse and "ON" period which is turned-on based on the falling edge of one scan pulse following the "Off" period.

3. The method of claim 1, wherein the pulse width modulation of the data pulses according to the grey scale of corresponding input data occurs within one scan pulse period.

4. The method of claim 3, wherein each of the data pulses are turned off at substantially the same time as the falling edge.

5. A method for driving a display panel using data signals, the method comprising:

setting all of a plurality of data signals to an off-logic level, wherein each of the data signals has a predetermined pulse width according to a gray scale of input data, and wherein all data signals are subsequently transitioned to an on-logic level according to the gray scale of input data within one scan pulse period, wherein the plurality of data signals that are subsequently transitioned to said on-logic level according to the gray scale of input data remain at said on-logic level within the scan pulse period, wherein each of pulses on anode lines according to applied data pulses is gradually changed to the on-logic level.

6. The method of claim 5, wherein the on-logic level of the data signals are maintained during the predetermined pulse width after being the off-logic level.

7. A method for driving an organic EL panel, comprising:

applying a scan pulse of period Ts to a scan electrode; and applying data pulses having variable pulse widths Tx according to a gray scale of input data to all anode electrodes corresponding to the scan pulse, wherein all of the variable pulse widths of the data pulses are modulated to be a first logic level corresponding to an on status for the period Tx after being a second logic level corresponding to an off status, which is complementary to the first logic level, for a period Ts−Tx based on the gray scale of input data, wherein each of the data pulses is gradually changed to the first logic level, and wherein said each of the data pulses is changed from the first logic level to the second logic level substantially at the end of the scan pulse period Ts.

* * * * *